US008215044B2

(12) United States Patent
Arbouw

(10) Patent No.: US 8,215,044 B2
(45) Date of Patent: Jul. 10, 2012

(54) SYSTEM AND METHOD FOR THE REMOTE MEASUREMENT OF THE AMMUNITION LEVEL, RECORDING AND DISPLAY OF THE CURRENT LEVEL

(75) Inventor: Paul Arbouw, Carmel, IN (US)

(73) Assignee: AWIS LLC

( * ) Notice: Subject to any disclaimer, the term of this patent is extended or adjusted under 35 U.S.C. 154(b) by 359 days.

(21) Appl. No.: 12/719,839

(22) Filed: Mar. 8, 2010

(65) Prior Publication Data

US 2010/0281725 A1 Nov. 11, 2010

Related U.S. Application Data

(60) Provisional application No. 61/175,743, filed on May 5, 2009.

(51) Int. Cl.
*F41A 9/62* (2006.01)

(52) U.S. Cl. ..... 42/1.02; 42/1.03

(58) Field of Classification Search ..... 42/1.01, 42/1.03, 49.01, 49.02, 50, 84; 89/33.1
See application file for complete search history.

(56) References Cited

U.S. PATENT DOCUMENTS

| | | | | | |
|---|---|---|---|---|---|
| 5,052,138 | A * | 10/1991 | Crain | 42/1.02 |
| 5,519,953 | A * | 5/1996 | Villani | 42/1.02 |
| 5,592,769 | A * | 1/1997 | Villani | 42/1.02 |
| 5,642,581 | A * | 7/1997 | Herold et al. | 42/1.02 |
| 5,799,432 | A * | 9/1998 | Wright et al. | 42/1.02 |
| 6,094,850 | A * | 8/2000 | Villani | 42/1.02 |
| 7,730,654 | B2 * | 6/2010 | Kim | 42/1.02 |
| 2008/0276517 | A1 * | 11/2008 | Delgado Acarreta | 42/1.02 |
| 2011/0030257 | A1 * | 2/2011 | Gwillim, Jr. | 42/1.02 |
| 2011/0252682 | A1 * | 10/2011 | Delgado Acarreta | 42/1.02 |
| 2011/0308125 | A1 * | 12/2011 | Gabay et al. | 42/1.02 |

* cited by examiner

*Primary Examiner* — Gabriel Klein
(74) *Attorney, Agent, or Firm* — Inna S. Shestul

(57) ABSTRACT

This invention relates to a method, system and computer program product that monitors usage for man carried weapon systems; specifically a device to monitor ammunition level and weapon discharges through real time data collection, analysis and real time visual feedback to the operator. An ammunition level detecting system mounted on a projectile weapon comprising: A level measurement unit (LMU) and a Reader and Visualization Unit (RVU) and a PC Dongle which configured to facilitate communication between the RVU and a personal computer (PC), enabling management of the RVU configuration and offloading of sensor obtained and system determined data values.

16 Claims, 5 Drawing Sheets

SYSTEM AND METHOD FOR THE REMOTE MEASUREMENT OF THE AMMUNITION LEVEL, RECORDING AND DISPLAY OF THE CURRENT LEVEL

CROSS-REFERENCE TO RELATED APPLICATION

This application is a non-provisional application of U.S. Provisional Patent Application No. 61/175,743, filed May 5, 2009, entitled System and Method for the Remote Measurement of the Ammunition Level, Recording and Display of the Current Level, which is incorporated by reference herein in its entirety.

BACKGROUND OF THE INVENTION

1. Field of Invention

This invention relates to a method, system and computer program product that allows for the real-time measurement of the level of ammunition contained within a magazine seated in a weapon system and providing a visible readout to the weapon operator's peripheral vision.

2. Background of Related Art

A concern, which many law enforcement, armed forces, or security personnel may encounter during a firearm confrontation, is the inability to determine with certainty when the load of ammunition in a firearm is running low in order to reload timely.

At the lack of an adequate weapon discharge reporting system that would provide crucial life preserving information to the user, currently adopted procedures in place, if any, are purely intuitive, and are acquired by training relying mostly on the user's state of mind. At any point during a never desired but possible confrontational firing event, the inevitable strain imposed by such circumstances, makes it extremely difficult for the user to keep a mental record of their ammunition consumption. Opting to replace a spent magazine is therefore turned into a hit and miss activity; a still partially loaded magazine is sometimes wastefully dropped and replaced for a new one in the attempt of not being caught on empty. It is widely known and accepted that human beings under stressful situations react more consistently when conditioned to respond to a sensorial reference than to an adopted routine that implies analytical thought and comparison to memorized data.

Several prior art disclosures describe claims with similar intent to monitor either shots fired or ammunition available within the magazine. While shots fired may provide useful information for statistical purposes, it does not directly aid the operator of the firearm. Other described claims perform a count-down function from an indicated starting point and thus require constant recalibration based on the size of the magazine and the actual amount of ammunition loaded into the magazine (Clark, Iredale, Bodmin, Leitner-Wise, & Andrew, 2007). A similar system is described in U.S. Pat. No. 5,566,486 (Brinkley, 1995). U.S. Pat. No. 7,509,766 (Vasquez, 2004) indicates a simple LED read out but is still reliant on a preset starting level.

U.S. Pat. No. 5,052,138 (Crain, 1989) describes a system based on position switches within a magazine and the detection of the mechanical action of the slide. The described system specifies components integrated specifically suitable for a handgun type firearm; with the magazine fully enclosed by the weapon.

Ammunition level indicating magazines that rely on mechanical systems have been claimed, but these occur outside of the operators view while operating the weapon. Translucent magazines allow for a (limited) visual inspection of the magazine without disengaging the magazine from the weapon (Musgrave, Daniel, & Cabin J., 1978).

Round expulsion counting by means of interference in an electromagnetic field was suggested by in U.S. Pat. No. 7,234,260 (Acarreta & Delgado, 2002). A system purely based on recoil was described in claim U.S. Pat. No. 7,356,956 (Schinazi, G., & de Rosset, 2005).

U.S. Pat. No. 5,826,360 (Herold & Herold, 1998) claims a self contained electronic counting system within a magazine, operating independently from a weapon system. This system positions the read out outside of the operators view and does not offer any storage or data extraction means. U.S. Pat. No. 6,094,850 (Villani, 2000) offers a similar system that is magazine based and relies on a combination of mechanical and electronic components U.S. Pat. No. 4,001,961 (Johnson & Weidner, 1977) describes a system based around the depressing of a sensor integrated into the firing system, either manually engaged by a trigger pull, or located elsewhere in the fire system like the buffer tube. The described system provides an unspecified method of system state indicator and does not specify any means of storage, data transfer or indication of current ammunition level within the system.

SUMMARY OF THE INVENTION

The presented invention is related to a system, method and computer program product that provides a real-time, accurate count of ammunition contained within the magazine contained within the weapon system, as well as provides an accurate and real-time count of discharges by the weapon system that the invention is attached to. Secondary functionality may be found in data logging for reconstruction of incidents involving the weapon being discharged, institutional logistics involving the number of discharges of the weapon and associated maintenance of the weapon, advanced battle space awareness and any and all other functions not yet determined but associated either directly or indirectly with the operating of a weapon system equipped with the system as described in the claim.

The system consists of a Level Measurement Unit (LMU), a Reader and Visualization Unit (RVU) and a USB PC Dongle.

A combination of sensor detectable material, contained within the magazine exterior shell, follower (LMU) and in cooperation with an array of detectable inputs within the measurement read-out unit (RVU) level changes are determined within the magazine and interpreted as either the manual ejection of a round, or the ejection of a round through the process of firing the weapon system. The system is designed to predominantly function within an environment with an ambient operating temperature between −40° C. and +85° C.; more extreme conditions may be possible to be serviced with specific configurations of the system described in the claim. The system is designed to be moisture resistant and possibly submersible under certain configurations of the system described in the claim.

Within the magazine, the target position sensing solution (LMU) may be inductive, where inductors move along Gray coded ferromagnetic material. The LMU may be mounted inside the "follower" of the receptacle/magazine.

The RVU consists of small size printed circuit board(s) (PCB) with amongst it various electronics components and sensors a power source and low power consumption display. The RVU electronics will be located inside a housing (polymer or other suitable material), providing protection from environmental elements and providing a means of attachment to a standard MIL-STD-1913 Picatinny rail or other attachment means as specific to the intended host weapon system.

The system operates at low voltage, conserving energy for a long duration operational time.

Appropriate signal protection/encryption will secure communication between LMU to RVU and RVU to Computer Interface.

Multi LMU management provides a means to appropriately handle multiple LMU's within reach of a wireless RVU configuration.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

The LMU system consists of an exterior shell augmented with sensors or detectable material that allows the LMU to determine its location within the exterior shell. Other means of determining the elevation of the LMU within the exterior shell may also be employed, which may alter the composition of parts associated with the exterior shell.

Within the exterior shell, the LMU is located atop a tension device (as indicated by the spring 106 in FIG. 1) that pushes the LMU and follower towards the top of the magazine with sufficient force to perform the ammunition loading function as designed for the specific weapon system. The tension device may or may not play part in the location determination of the LMU within the exterior shell.

Figure 1:
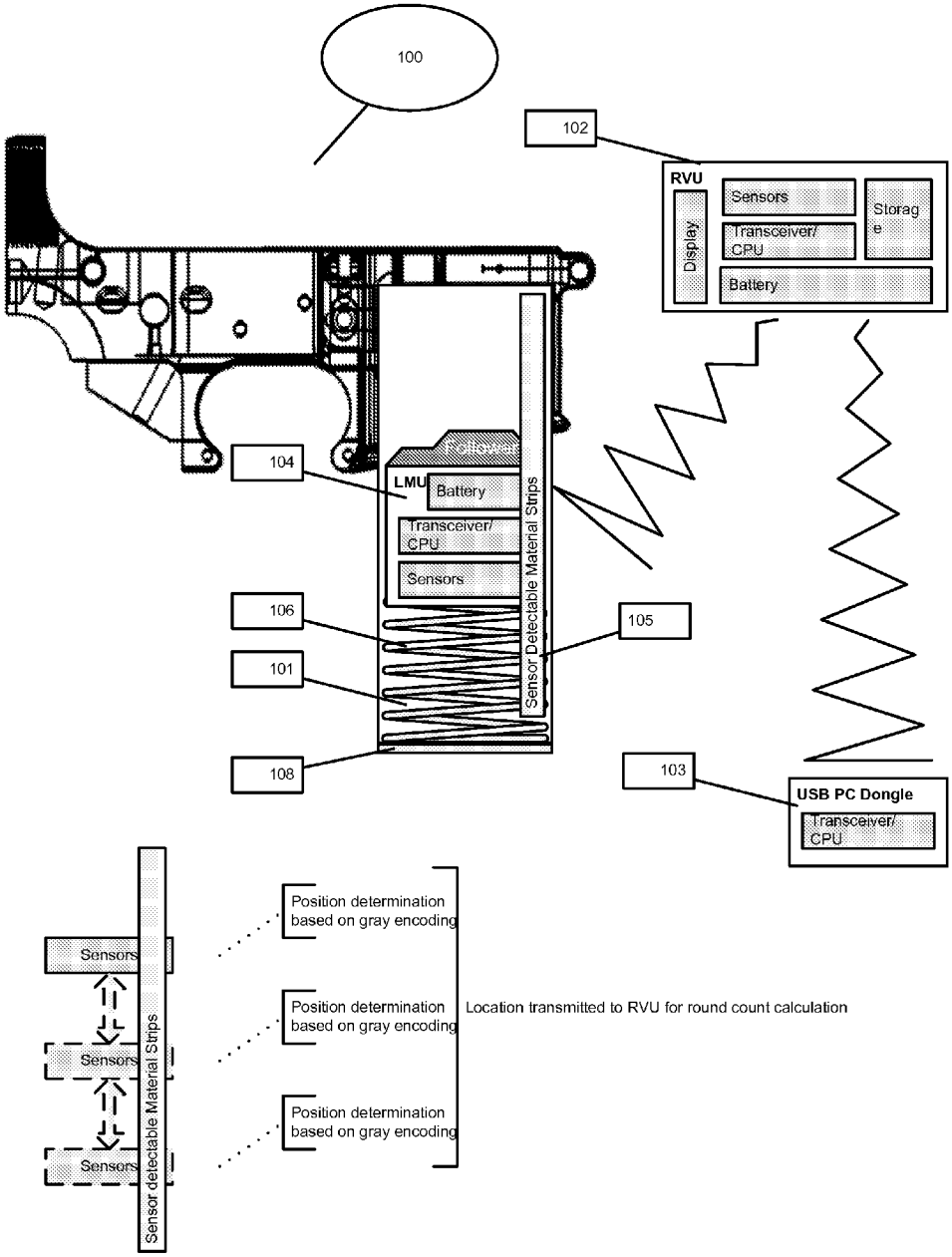
FIG. 1 shows one exemplary ammunition level detecting system in accordance with one embodiment.

The LMU may contain the circuitry to both determine the location of the LMU within the exterior shell, as well as the interface means to communicate with the RVU. Similar circuitry could also be affixed to exterior shell depending on the sensor selection and means of level determination within the magazine. FIG. 1 indicates a possible configuration with a power source and sensors responding to ferromagnetic material located on top of a spring and below the follower.

A follower, standard to the design of the ammunition for the specific weapon system, completes the top side of the LMU and allows for the ammunition to be fed into the weapon system as designed by the manufacturer.

FIG. 1 shows one exemplary 1 ammunition level detecting system 100 in accordance with one embodiment. Each magazine contained within the weapon system is filled with ammunition, the level of which is monitored and measured upon sensory input (automatic or manually initiated) using an ammunition level detecting system 100. Each weapon is equipped with a magazine 101 containing a Level Measurement Unit ("LMU") 104 that communicates with a Reader and Visualization Unit ("RVU") 102, (preferably) via a wireless communication. When the RVU 102 detects a magazine level below a threshold value or completely empty, an alert status is generated and displayed on the RVU display. Data collected by the RVU can be transmitted to a USB PC Dongle 103. Accelerometer input, or the lack there off, at the time of an ammunition level recording, may be interpreted as the manual ejection of a round, assuming the LMU identification number is identical to the previous reading, indicating a continuous statistic for the same magazine.

The magazine 101, as indicated in FIG. 1, further includes a LMU with follower 104, grey encoded ferromagnetic strip(s) 105, which are mounted in channels on the inside of the magazine shell 101 in order to provide both environmental protection and reduce the distance between the material and the LMU 104 based sensors. Ferromagnetic strips are encoded to accommodate a step resolution consistent with the indicated ammunition capacity of the magazine 101. Ferromagnetic grey encoding identified resolution point combined with the RVU configured caliber for the ammunition stack allows for the mathematical determination of the level of the ammunition stack. The LMU 104 is positioned on top of a spring 106 and a base plate 108. The spring moves the follower/LMU 104 up along the side of the ferromagnetic strip(s) 105 as the ammunition stack is reduced in the magazine.

Figure 2:
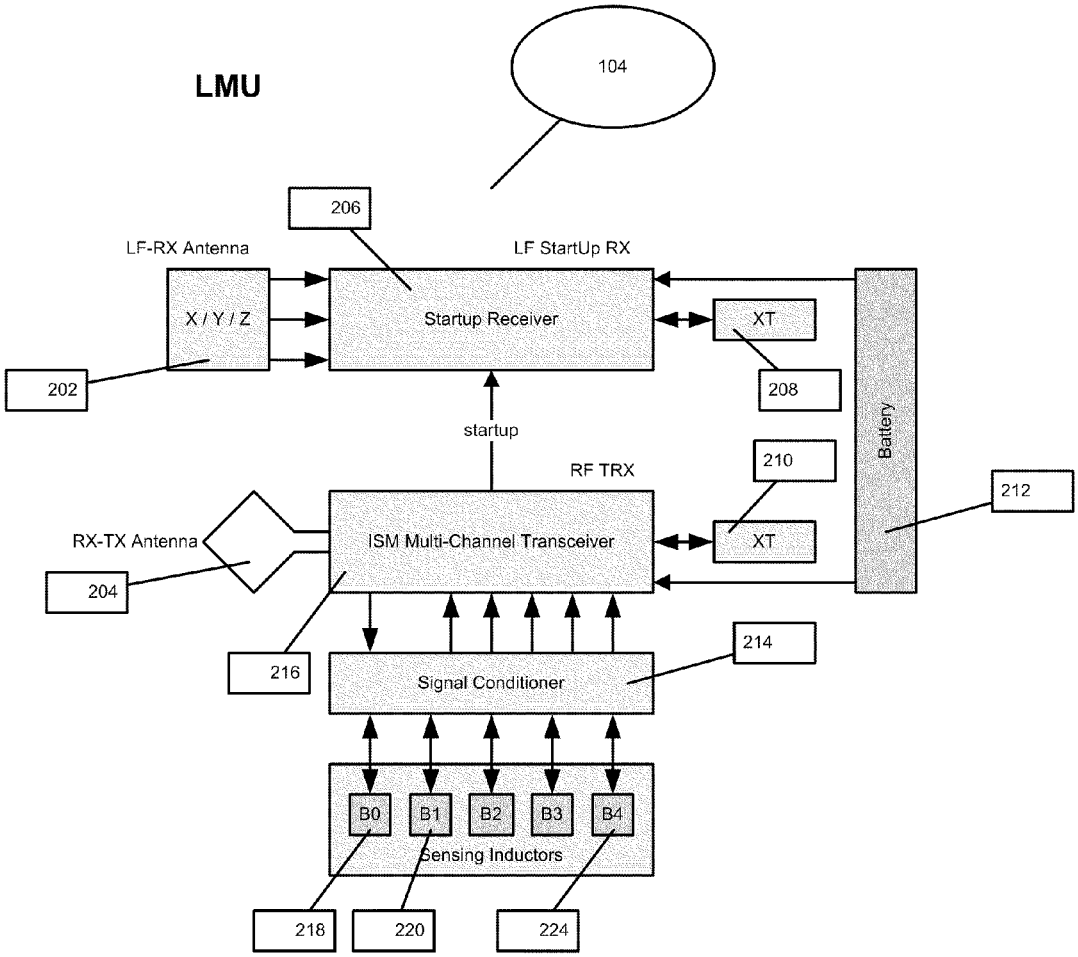
FIG. 2 is a block diagram of a level measurement unit (LMU).

FIG. 2 is a block diagram of the LMU 104. Includes a plurality of Sensing Inductors 218-224, a Start-up receiver 206, a wireless communication interface (not shown), an Antenna Block 204 and a Power Unit (battery) 212, an ISM Multichannel Transceiver 216 and a Signal Conditioner 214. The wireless Interface may use either one of the standard type Unlicensed International Frequency transceiver like Bluetooth, Zigbee™, etc or proprietary (military) protocols.

Furthermore, in the LMU the Inductive sensors 218-224 are adopted to read the Gray Encoded Ferromagnetic material 105 in the magazine exterior shell 101 to determine the level of fill in the magazine. Transceiver and CPU communicate with the RVU to transfer data and receive operation commands like wake-up and deep-sleep commands.

In LMU 104, a 3.6 volt, 1.6 Ah power source best suited to the system configuration and client mission requirements is located. This may either be a disposable power source or a power source with wireless charging capability.

A magazine shell is a Polymer shell to house Follower/LMU 104 and hold ammunition for the indicated caliber and volume. Further, the gray encoded ferromagnetic strip(s) 105 are integrated into the polymer shell in order to allow the Follower/LMU 104 to identify its location within the magazine shell 101.

Figure 3:
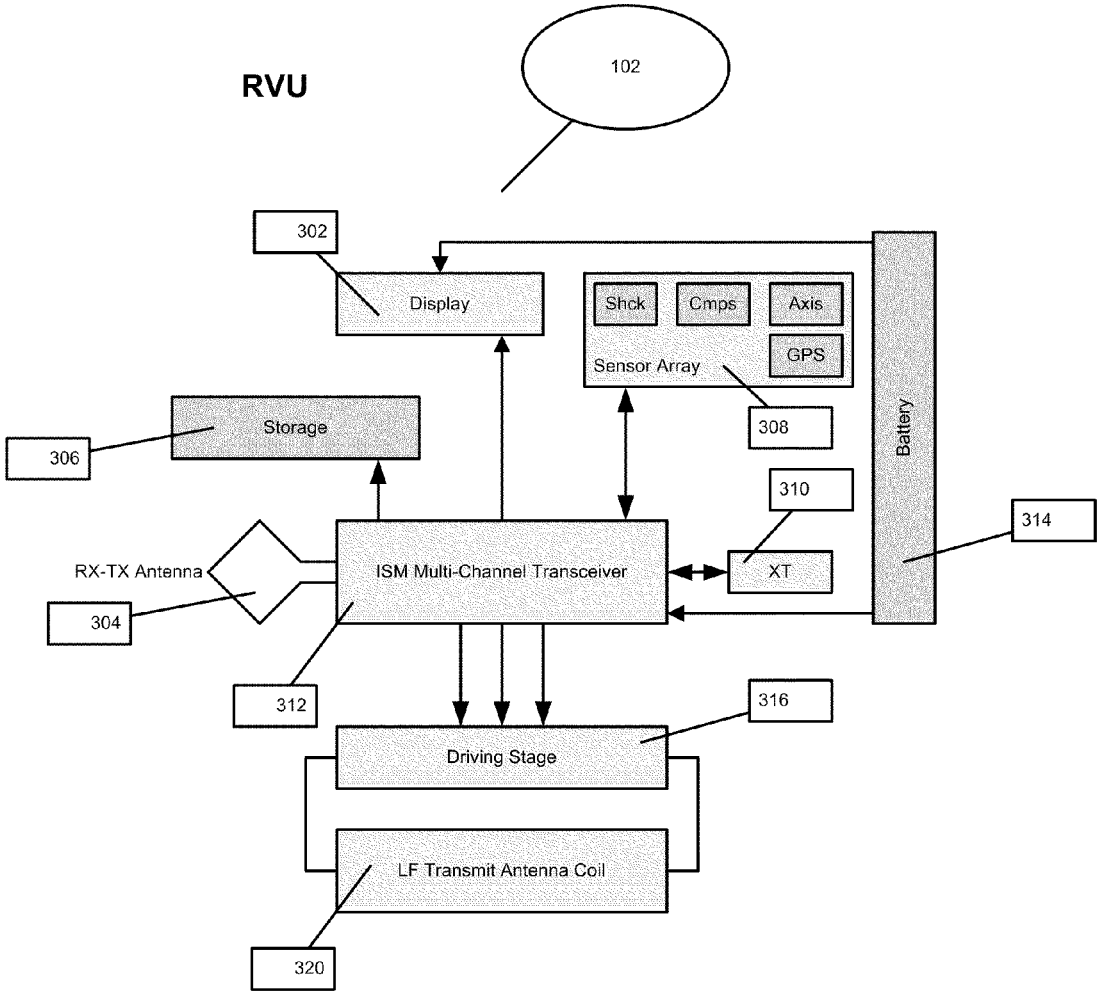
FIG. 3 is a block diagram of a Reader and Visualization Unit (RVU).

FIG. 3 is a block diagram of the Reader and Visualization Unit (RVU) 102. The RVU 102 includes an (OLED) Display 302, a sensor array 308, containing an accelerometer and other environmental inputs, a wireless communication interface (not shown), an Antenna Block 304 and a Power Unit (battery) 314, an ISM Multichannel Transceiver 312, a Driving Stage 316, a Storage means 306 and a LF Transmit Antenna Coil 320, a processor (CPU) (not illustrated). The WLAN Interface uses one of the standard type Unlicensed International Frequency transceiver like Bluetooth, Zigbee™ etc or a proprietary (military) protocol.

The Sensor Array 308 illustratively shown in FIG. 3 contains a (piezo-electric) accelerometer, an electronic Compass, a GPS, a Multi-Axis MEMS sensor, and a Sensor control parameters of surroundings. Sensor control parameters of surroundings may include one or more of: a Temperature Sensor, a Barometric Pressure Sensor, a Humidity Sensor, Range Finder, etc. The Antenna block 304 includes a GPS antenna, a low power LAN antenna and any additional antenna type as required by the RVU configuration.

Initially the RVU and the LMU are in deep sleep mode. After manually, or automatically via accelerometer input, turning on the RVU, the RVU boots up and sends in intervals a startup pattern to the LMU. After each sending of a startup pattern it goes for a short interval into a receive-mode to receive LMU identification information and the fill level from the LMU via a data transfer method. If the LMU receives a startup pattern, it starts up, determines the LMU position along the sensor detectable material and transmits the position to the RVU. Upon successful completion of the data transfer it the LMU goes back to deep sleep mode upon the configured interval of inactivity from the RVU. Upon successful completion of the data transfer it the RVU goes back to deep sleep mode upon the configured interval of inactivity from either user- or sensor input or a CPU command. When the RVU receives a position value, it stores the information with a date/time stamp (as well as any other configured/available data) in storage 306 and updates the display value on display 302. Upon completion of this process the RVU goes to sleep mode waiting for a timer interrupt, or any other input method restarting the fill level request process, to request new fill level/position value. The RVU communicates with the LMU via encrypted communication with an operational range of 2 feet.

RVU uses a removable (disposable) 3.6 volt, 1.6 Ah power source consisting of 2 CR123A or equivalent batteries.

The RVU may utilize a piezo-electric accelerometer in order to conserve power consumption from the power source. Piezo-electric property needs to be sufficient to trigger wake-up procedures. Also, the RVU may utilize piezo-electric buttons for the human interface in order to minimize power consumption from the battery and in order to provide enough current to bring the system from deep sleep mode. If not utilizing a piezo-electric interface, a very low power consumption option can be utilized.

The GPS unit compliant with NAVSTAR and its associated anti-tamper and security architecture.

Further, the power source is located at the bottom of the system in order to provide the (GPS) antenna(s) a clear view of the sky.

The (OLED) Display 302 is mounted at 15 degree angle towards the mounting rail/operator providing optimal view to the operator's peripheral vision and minimizing external light signature.

Mounting solution that allows the RVU to be mounted on a MIL-STD 1913A Picatinny rail or other weapon system standard accessory rail.

Within the RVU the (Piezo-electric or low power consuming) accelerometer is used to identify a discharge event, i.e. to measure the g-force generated by the weapon discharge or manual ejection of a round.

External to the RVU housing, a Human interface to manipulate RVU settings and trigger manual level measurement cycle.

Within the RVU, an electronic compass is used to determine the cardinal direction of the host weapon system.

Within the RVU, a Multi-axis MEMS sensor is used to determine the elevation of the host weapon system.

Within the RVU, a multi-antenna array used to facilitate RVU to LMU, RVU to PC Dongle and GPS communication.

Within the RVU, additional environmental sensory inputs (i.e. temperature, barometric pressure, humidity, etc) may be added to the RVU to provide additional data recordings in specific configurations.

PC Dongle: Transceiver and CPU to facilitate RVU to PC to RVU communication and interface with the PC based RVU management software.

The USB PC Dongle 103 illustrated in FIG. 1, provides USB2 or USB3 connectivity from the dongle to a PC computer. Also, the Dongle 103 provides RVU encrypted communication with an operational range of up to 10 feet, works with a software interface to allow recorded data to be off-loaded from the RVU. Including, but not limited to: Weapon serial number, Longitude at time of data collection, Latitude at time of data collection, Date at time of data collection, Time of data collection, Cardinal direction of the host weapon system at time of data collection, System incline at time of data collection, Discharge indication at time of data collection, LMU serial number at time of data collection and RVU serial number. Also, the Dongle 103 provides a software interface to allow RVU configuration settings to be entered/updated. Including, but not limited to: Weapon serial number, Weapon caliber, User identification, Date, Time, and Time zone.

System Process Flow

Figure 4:
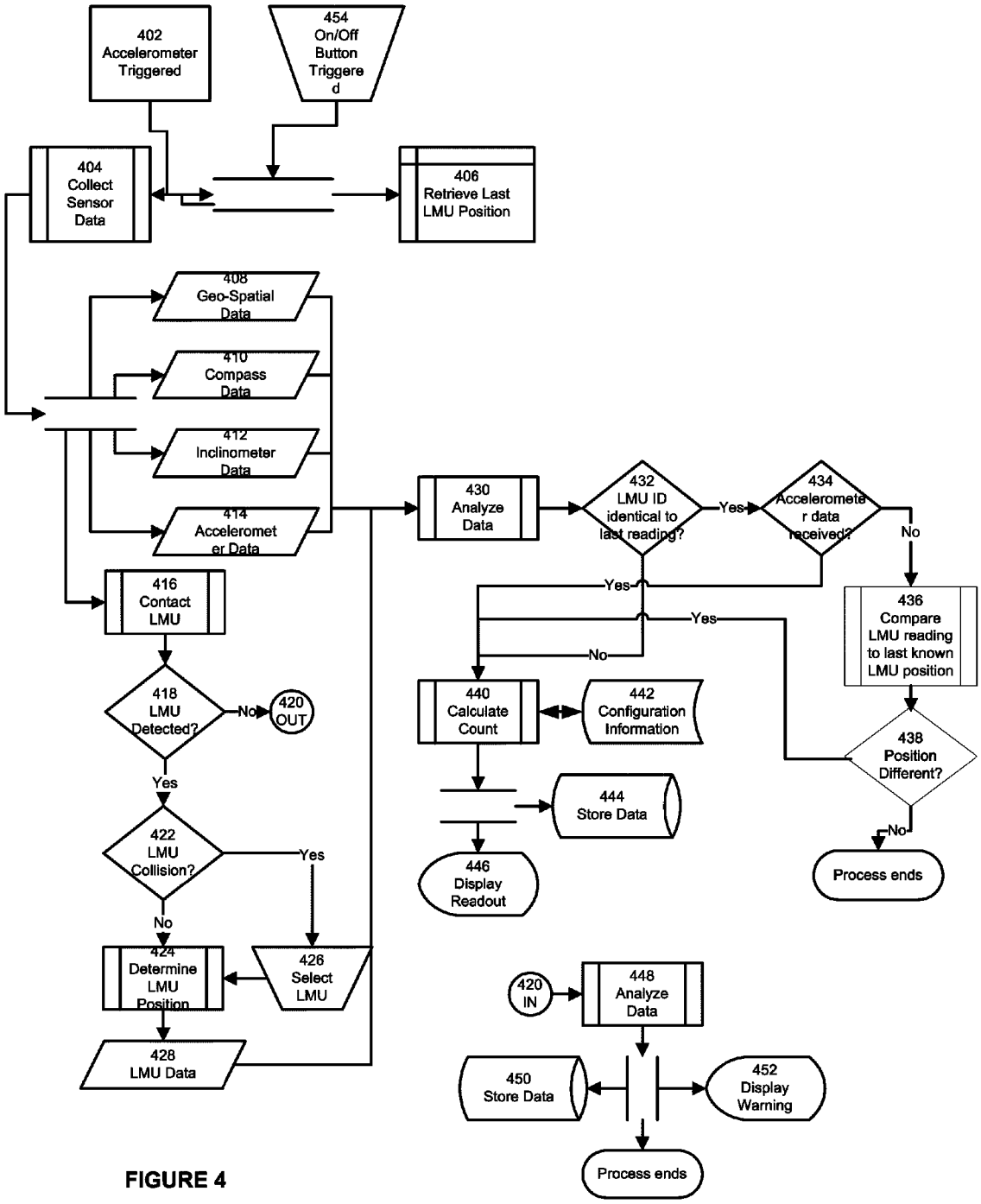
FIG. 4 is a flowchart of method for detecting and registering an ammunition fill level by the ammunition level detecting system.

FIG. 4 is a flowchart of method for detecting and registering an ammunition fill level by the ammunition level detecting system. The recoil action of the host weapon triggers the accelerometer in the Step 402 and once a reading above a preconfigured level is determined (to accommodate for various calibers/loads and suppressed and unsuppressed fire), the sensor measurement cycle is started. The RVU system polls the various input sensors and collects their readings in parallel in the Step 404.

In parallel, in Step 406 RVU determines the last known LMU position and ID of the LMU for later comparison.

In Step 408 GPS reading is taken and the data prepared for analyzing/storage. In Step 410 Electronic compass reading is taken and the data prepared for analyzing/storage. In Step 412 multi-axis MEMS sensor reading is taken and the data prepared for analyzing/storage. In Step 414 Accelerometer data is prepared for analyzing/storage.

In Step 416 Startup pattern is prepared to be sent to LMU. In Step 418 RVU determines if one or more LMU's are within range.

If no LMU's are determined to be within range (or in possession of a working power source) an alternate process is selected to continue the current processing cycle as illustrated in Step 420.

In Step 422 RVU determines if two or more LMU's are detected (i.e, a LMU collision). If only a single LMU is detected, the startup pattern 416 is sent to the LMU and the LMU determines its current position along the ferromagnetic grey encoded material as illustrated in Step 424. If two or more LMU's are detected, the RVU enters LMU collision mode and allows for the selection of the user desired LMU as shown in Step 426.

In Step 428 the LMU measurement data is returned to the LMU and prepared for analyzing/storage.

In Step 430 the RVU analyzes the sensory input and prepares it for processing and storage. In Step 432 RVU determines if the LMU ID from the LMU providing the current reading is identical to the LMU ID of the last known reading.

In Step 434 RVU determines if the accelerometer provided a reading above the preset threshold level and determines the next step in the process based upon the accelerometer reading.

In Step 436 RVU determines if the current LMU reading is identical to the last known reading.

In Step 438 RVU determines the next course of action based upon the determination as made in Step 436. Process ends if the reading is identical. In Step 440 RVU calculates the current ammunition stack based upon prepared LMU data and system configuration information 442.

In Step 442 RVU provides system configuration information (like caliber as used in the host weapon) to the ammunition stack calculation process 440. In Step 444 all prepared sensory data and the results of the ammunition stack calculation are stored in the RVU.

In Step 446 the results of the ammunition stack calculation are displayed on the (OLED) Display 302 of the RVU 102.

In Step 448 the continuation from the process determination that no LMU is present from the Step 420. In this step RVU also analyzes the provided sensory data and prepares it for storage and display (excluding any LMU readings.

In Step 450 RVU stores the prepared sensory data in the RVU's data storage device.

In step 452 RVU displays a warning on the RVU display that no LMU was detected during the sensory input cycle.

Alternatively to accelerometer input, in Step 454 the human interface records an action and the sensor measurement cycle is started.

Figure 5:
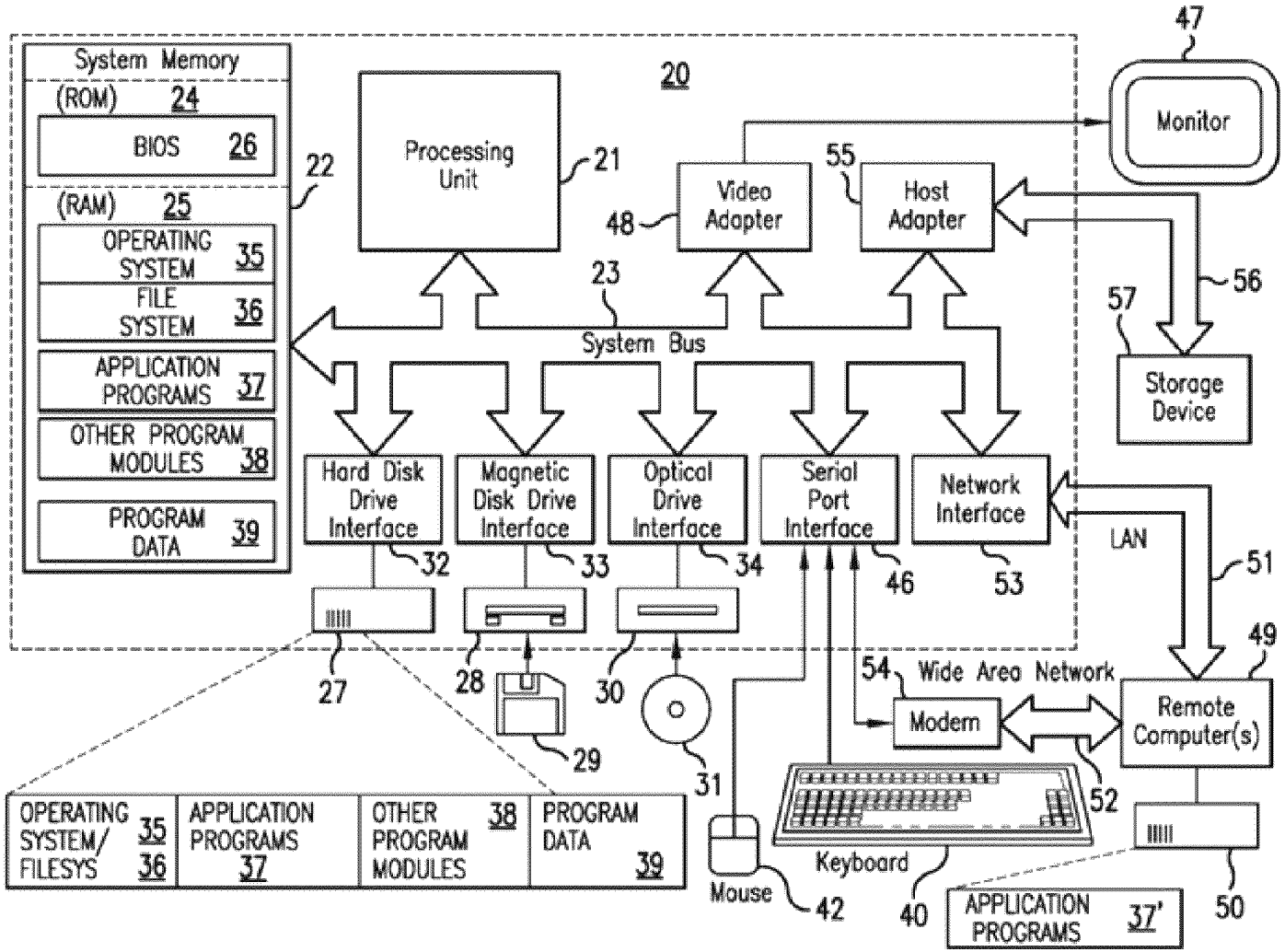
FIG. 5 is an example of the computing system where the present invention may be implemented.

With reference to FIG. 5, an exemplary system for implementing the invention includes a general purpose computing device in the form of a personal computer or server 20 or the like, including a processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read-only memory (ROM) 24 and random access memory (RAM) 25. A basic input/output system 26 (BIOS), containing the basic routines that help to transfer information between elements within the personal computer 20, such as during start-up, is stored in ROM 24. The personal computer 20 may further include a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD-ROM, DVD-ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide non-volatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media that can store data that is accessible by a computer, such as magnetic cassettes, flash memory cards, digital video disks, Bernoulli cartridges, random access memories (RAMs), read-only memories (ROMs) and the like may also be used in the exemplary operating environment.

A number of program modules may be stored on the hard disk, magnetic disk 29, optical disk 31, ROM 24 or RAM 25, including an operating system 35 (preferably Windows™ XP or higher). The computer 20 includes a file system 36 associated with or included within the operating system 35, such as the Windows NT™ File System (NTFS), one or more application programs 37, other program modules 38 and program data 39. A user may enter commands and information into the personal computer 20 through input devices such as a keyboard 40 and pointing device 42. Other input devices (not shown) may include a microphone, joystick, game pad, satellite dish, scanner or the like. These and other input devices are often connected to the processing unit 21 through a serial port interface 46 that is coupled to the system bus, but may be connected by other interfaces, such as a parallel port, game port or universal serial bus (USB). A monitor 47 or other type of display device is also connected to the system bus 23 via an interface, such as a video adapter 48. In addition to the monitor 47, personal computers typically include other peripheral output devices (not shown), such as speakers and printers.

The personal computer 20 may operate in a networked environment using logical connections to one or more remote computers 49. The remote computer (or computers) 49 may be another personal computer, a server, a router, a network PC, a peer device or other common network node, and typically includes many or all of the elements described above relative to the personal computer 20, although only a memory storage device 50 has been illustrated. The logical connections include a local area network (LAN) 51 and a wide area network (WAN) 52. Such networking environments are commonplace in offices, enterprise-wide computer networks, Intranets and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Having thus described a preferred embodiment, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. A system for the real-time measurement of a level of ammunition contained within a magazine seated in a host weapon and providing a visible readout to the weapon operator's peripheral vision, the system comprising:

a magazine configured to be removably coupled to the host weapon, the magazine comprising a magazine shell for housing ammunition, a follower that provide a mounting platform for electric components and positions ammunition within the magazine shell, a follower spring, a gray encoded ferromagnetic strip within a wall of the magazine shell, at least one sensing inductor inside the follower to read a magnetic signal from the gray encoded ferromagnetic strip at a specific point on the shell indicating an ammunition fill level in the magazine, and a Level Measurement Unit (LMU) capable of monitoring a level of ammunition based on the magnetic signal read by the at least one sensing inductor and providing follower position data;

a Reader and Visualization Unit (RVU) which is configured to communicate with the LMU and receives follower position data transfer from the LMU, the RVU including at least one sensor that automatically turns on the system and wakes up the LMU and obtains a reading from the LMU, a storage means that stores the reading obtained from the LMU and a display that provides a read-out of the ammunition level, as calculated by the RVU based on the follower position data and RVU configuration data, and provides a visible interface to configure the system settings; and a PC Dongle which is configured to facilitate communication between the RVU and a personal computer (PC), enabling management of the RVU configuration and offloading of sensor obtained and system determined data values.

2. The system of claim 1, wherein the RVU contains a central processor unit (CPU) capable of turning the LMU into a deep sleep mode to conserve power.

3. The system of claim 1, wherein the RVU contains a transmitter for data transfer and communication between the RVU and LMU.

4. The system in claim 3, wherein the transmitter is capable of waking up the LMU on demand.

5. The system of claim 1, wherein the RVU further comprises: a housing containing electronic components, attached to a mounting solution allowing the attachment to a projectile weapon utilizing a box magazine.

6. The system of claim 1, wherein the RVU further comprises an accelerometer sensor responsive to the g-force level generated by the weapons discharge.

7. The system of claim 1, wherein the RVU further comprises a central processing unit (CPU) that upon detection of a sufficient spike in g-force powers up the system and signals the LMU to take a reading.

8. The system of claim 1, wherein the storage of the RVU is capable of recording data and allowing the CPU to access said data in analyzing system activation based upon discharge, or round expulsion based on a means other than weapon discharge.

9. The system of claim 1, wherein the RVU further comprises an antenna array that transfers said data and operating commands to the LMU.

10. The system of claim 1, wherein the RVU further comprises at least five user interface buttons to both navigate the settings of the system as well power up the system and trigger a signal for the LMU to take a reading.

11. The system of claim 1, wherein the RVU further comprises a wired and/or wireless interface to allow data transfer from the storage to a computer or other data collection device.

12. The system of claim 11, wherein a GPS location is provided to the RVU from an external GPS source.

13. The system of claim 11, wherein a GPS location is determined via a sensor within the RVU.

14. The system of claim 11, wherein a cardinal compass bearing is provided to the RVU via an electronic compass within the RVU.

15. The system of claim 11, wherein an angle reading is provided to the RVU via a multi-axis MEMS sensor within the RVU.

16. A method for the real-time measurement of a level of ammunition contained within a magazine seated in a host weapon and providing a visible readout to the weapon operator's peripheral vision, the method comprising:

providing a magazine configured to be removably coupled to the host weapon, the magazine comprising a magazine shell for housing ammunition, a follower that provide a mounting platform for electric components and positions ammunition within the magazine shell, a follower spring, a gray encoded ferromagnetic strip within a wall of the magazine shell, at least one sensing inductor inside the follower to read a magnetic signal from the gray encoded ferromagnetic strip at a specific point on the shell indicating an ammunition fill level in the magazine, and a Level Measurement Unit (LMU) capable of monitoring a level of ammunition based on the magnetic signal read by the at least one sensing inductor and providing follower position data providing a Reader and Visualization Unit (RVU) to communicate with the LMU and receive follower position data transfers from the LMU, the RVU including at least one sensor that automatically turns on the system and wakes up the LMU and obtains a reading from the LMU, a storage means that stores the reading obtained from the LMU and a display that provides a read-out of the ammunition level, as calculated by the RVU based on the follower position data and RVU configuration data, and provides a visible interface to configure the system settings; and providing a PC Dongle to facilitate communication between the RVU and a personal computer (PC), enabling management of the RVU configuration and offloading of sensor obtained and system determined data values.

* * * * *